US006254149B1

(12) United States Patent
Shaffer et al.

(10) Patent No.: US 6,254,149 B1
(45) Date of Patent: Jul. 3, 2001

(54) LIVE BOLT LATCHING AND RELEASING SYSTEM

(75) Inventors: Douglas E. Shaffer, Victor; Leland E. Emery, Avon, both of NY (US)

(73) Assignee: John D. Bush & Co., Inc., Rochester, NY (US)

( * ) Notice: Subject to any disclaimer, the term of this patent is extended or adjusted under 35 U.S.C. 154(b) by 0 days.

(21) Appl. No.: 09/130,941

(22) Filed: Aug. 7, 1998

Related U.S. Application Data

(60) Provisional application No. 60/055,755, filed on Aug. 14, 1997.

(51) Int. Cl.[7] ..... E05B 63/20
(52) U.S. Cl. ..... 292/333; 292/160
(58) Field of Search ..... 292/142, 172, 292/39, 332, 333, 335, 160

(56) References Cited

U.S. PATENT DOCUMENTS

| | | | | |
|---|---|---|---|---|
| 228,323 | * | 6/1880 | Crandal | 292/333 |
| 393,449 | | 11/1888 | Prescott . | |
| 609,416 | | 8/1898 | Damon . | |
| 812,044 | * | 2/1906 | Kasselman | 292/332 |
| 1,037,302 | * | 9/1912 | Parent | 292/332 |
| 1,107,736 | | 8/1914 | Wilkinson . | |
| 1,198,862 | * | 9/1916 | McCormack | 292/332 |
| 1,302,873 | | 5/1919 | Stiff . | |
| 1,330,693 | | 2/1920 | Fisher . | |
| 1,340,398 | | 5/1920 | O'Brien . | |
| 2,597,056 | | 5/1952 | Beder . | |
| 3,621,686 | | 11/1971 | Klein . | |
| 4,154,070 | | 5/1979 | Bahry . | |
| 5,603,534 | * | 2/1997 | Fuller | 292/2 |

FOREIGN PATENT DOCUMENTS 398941 9/1933 (GB) .

* cited by examiner

*Primary Examiner*—Gary W. Estremsky
(74) *Attorney, Agent, or Firm*—Eugene Stephens & Associates

(57) ABSTRACT

A latching system for live bolts as in a door retains the live bolts within the door until the door is closed. A latch holds a live bolt link against travel that would insert the live bolts into the door body jamb until a link lifter forces the link out if the latch against the bias of a hold-down spring. The link lifter can take the form of an inclined surface on a cam mounted on the hinge side of the door. The cam engages the door body jamb as the door closes and travels into the door until the link lifter engages and lifts the link out of the latch.

31 Claims, 7 Drawing Sheets

LIVE BOLT LATCHING AND RELEASING SYSTEM

This application claims the benefit of U.S. Provisional Application No. 60/055,755, filed on Aug. 14, 1997, which provisional application is incorporated by reference herein.

TECHNICAL FIELD

The invention relates to latching systems for live bolts.

BACKGROUND

Live bolt systems for doors can be damaged when an operator tries to close the door with the live bolts extended. In safes, this can occur after the safe door has been opened and the handle of the safe is accidentally bumped or turned, extending the live bolts. In some cases, damage is done to other components of the door or even to the safe itself. Repair or replacement of the damaged parts can be costly and may result in a period during which the safe cannot be used. Thus, there is a need for a live bolt system that will not extend the live bolts as a result of accidental bumping or unintentional turning of a safe door handle.

Latching systems exist in the prior art, but suffer from disadvantages that need to be overcome. Many systems, such as gravity-biased live bolt systems, involve a long series of cams, bars, and levers, creating a relatively high risk of failure as a result of the large number of parts involved. In addition, the large number of parts increases the cost of such systems. A need therefore exists for a lower cost latching system with fewer parts to reduce the risk of failure.

Other systems, such as some spring-biased systems, are simpler, but have other problems. While fewer parts are used, these systems still use more parts than necessary, resulting in higher system cost and complexity. Additionally, accidental latch release is likely as a result of actuator placement and design. If the actuator is changed to prevent accidental release, then the door becomes difficult to close. Therefore, a need exists for a simpler, lower cost latching system that is more secure against accidental release, but does not inhibit closing of the door.

SUMMARY OF THE INVENTION

Our live bolt latching system provides automatic retention and release of live bolts with fewer parts than prior art systems. Our system is also more secure against accidental release of the live bolts. A spring biases a live bolt link into a latch that prevents live bolt extension. A cam preferably mounted in the hinge side of the door actuates a link lifter that moves the link out of the latch when the door is closed, allowing the bolts to extend. In the preferred embodiment of our invention, springs bias the live bolts for automatic extension of the live bolts upon closure of the door. Because of the design and placement of the cam, accidental release of our latching system is much less likely than in prior art systems. Further, our latching system is less likely to fail because it uses fewer parts than prior art latching systems.

DESCRIPTION OF THE INVENTION

Figure 1:
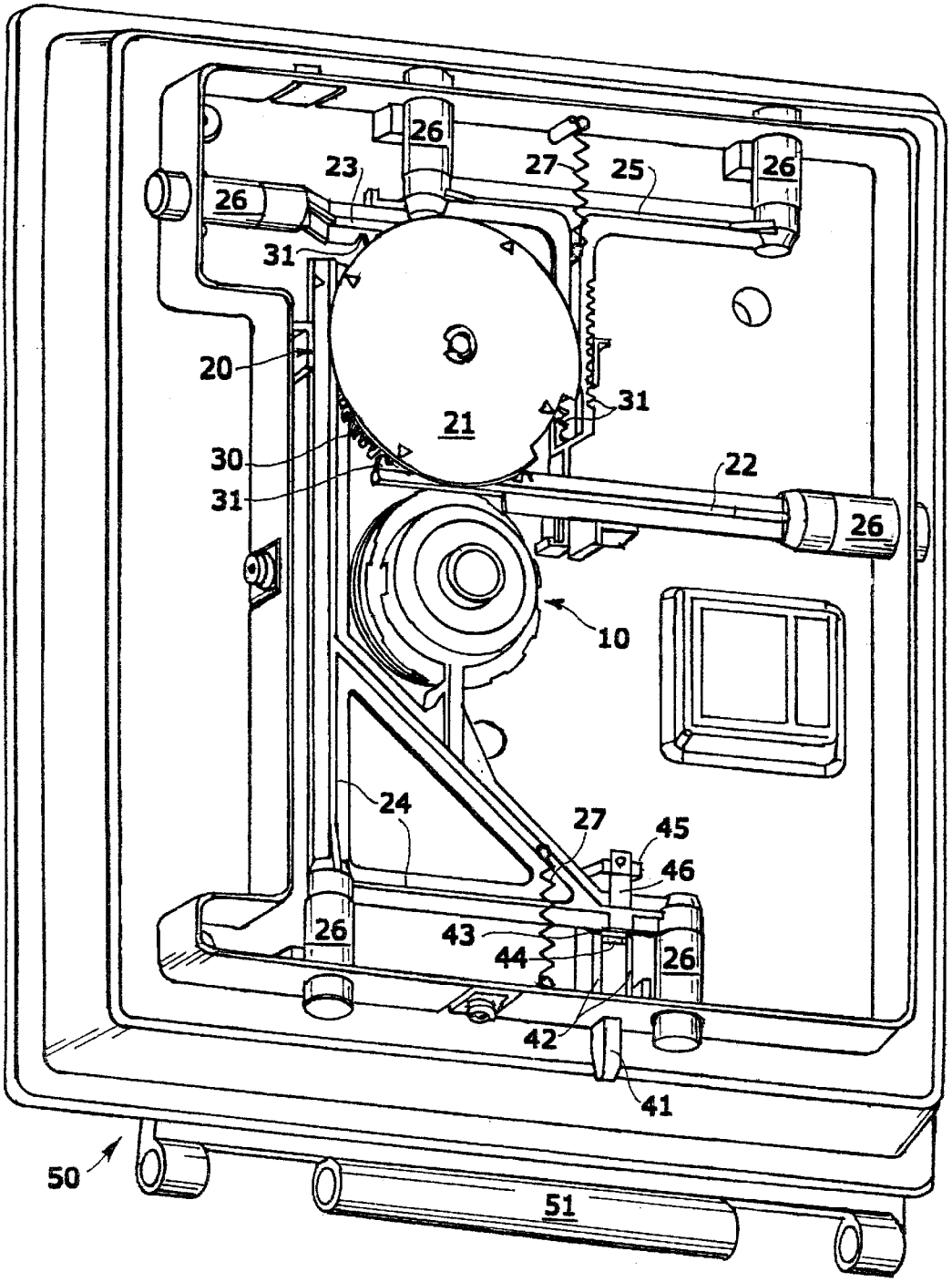
FIG. 1 is an isometric view of the back of a safe door including a live bolt latching system according to the invention.
Figure 2:
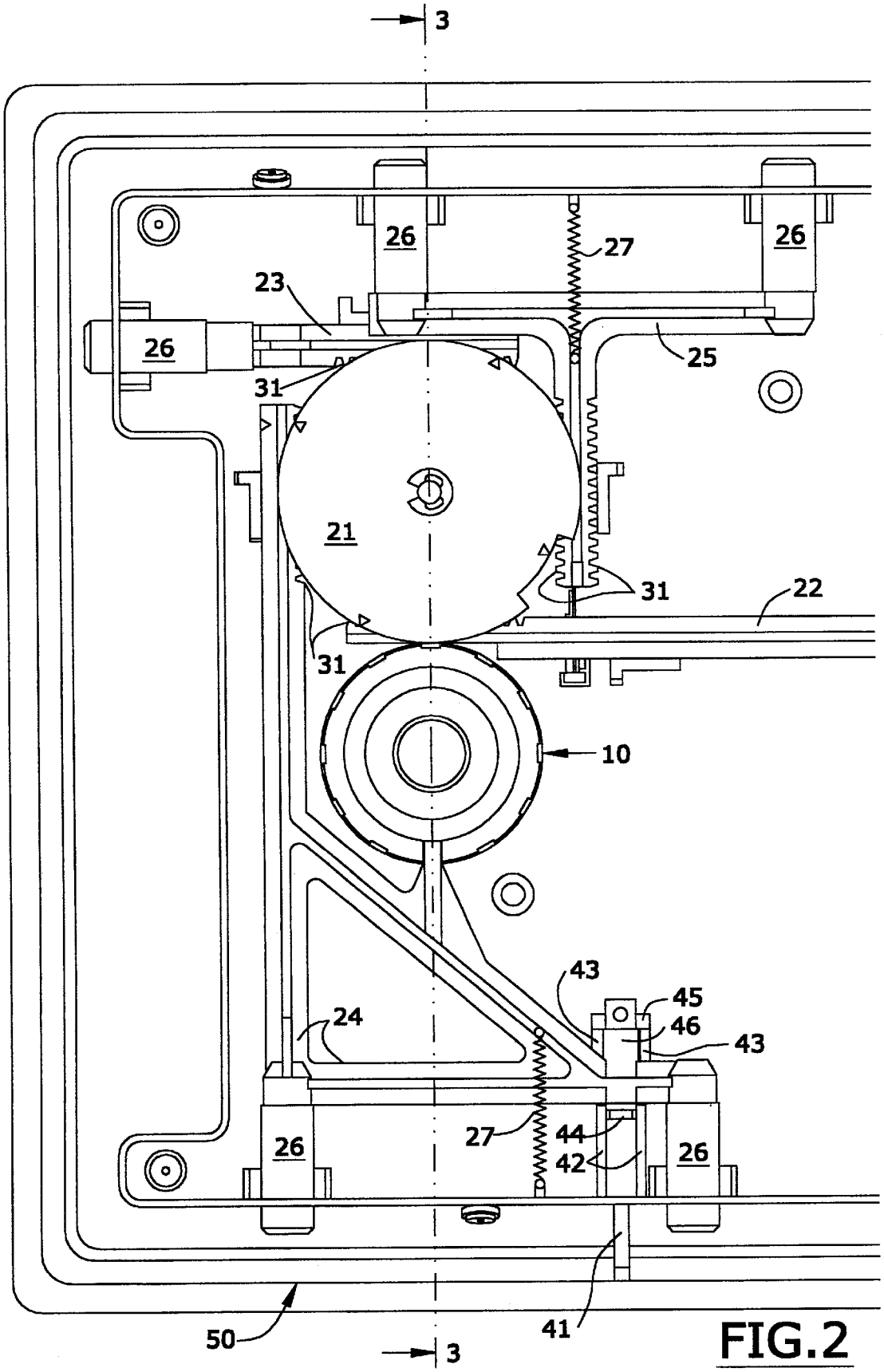
FIG. 2 is an elevation view of the back of the safe door shown in FIG. 1.
Figure 3:
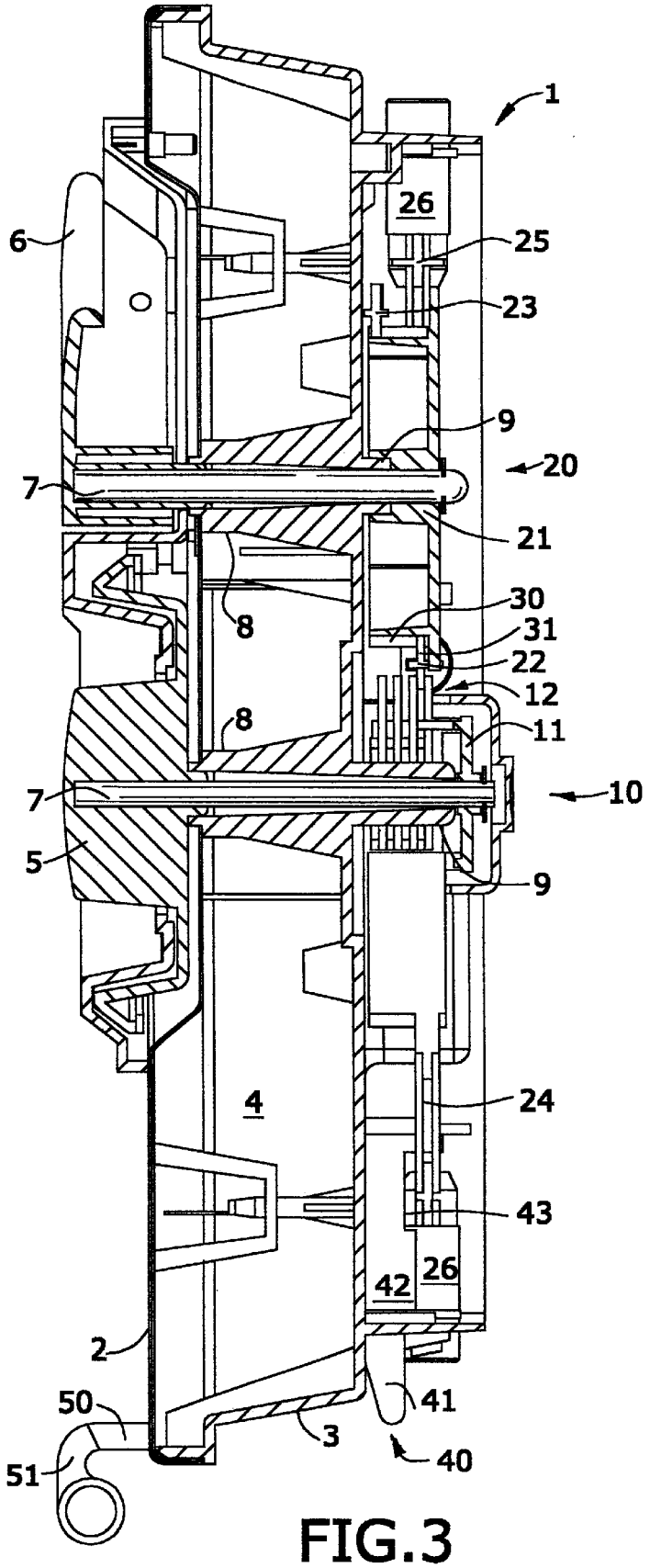
FIG. 3 is a cross section of the door shown in FIG. 2 taken along line 3—3.
Figure 4:
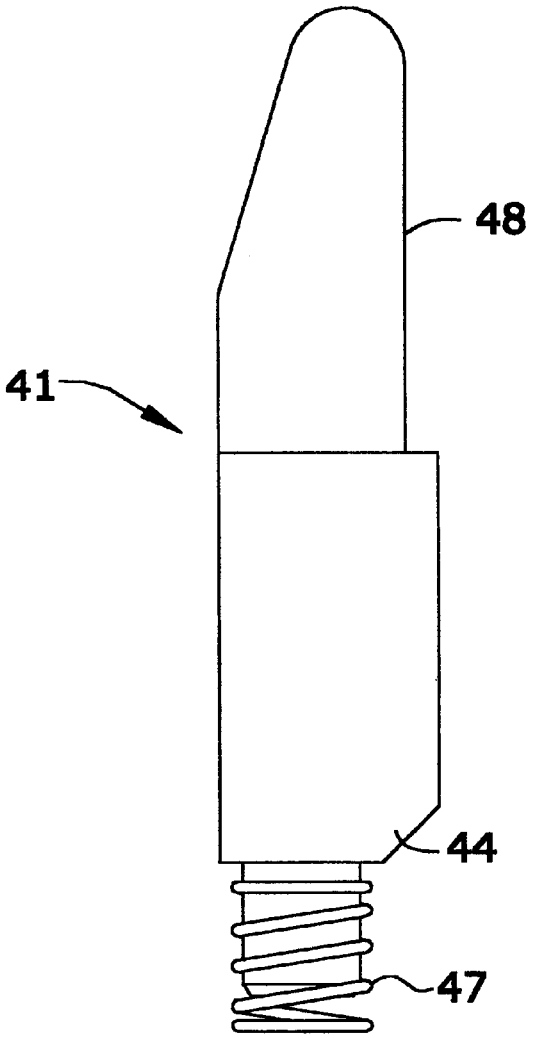
FIG. 4 is a side view of the cam and link lifter of the invention.
Figure 5:
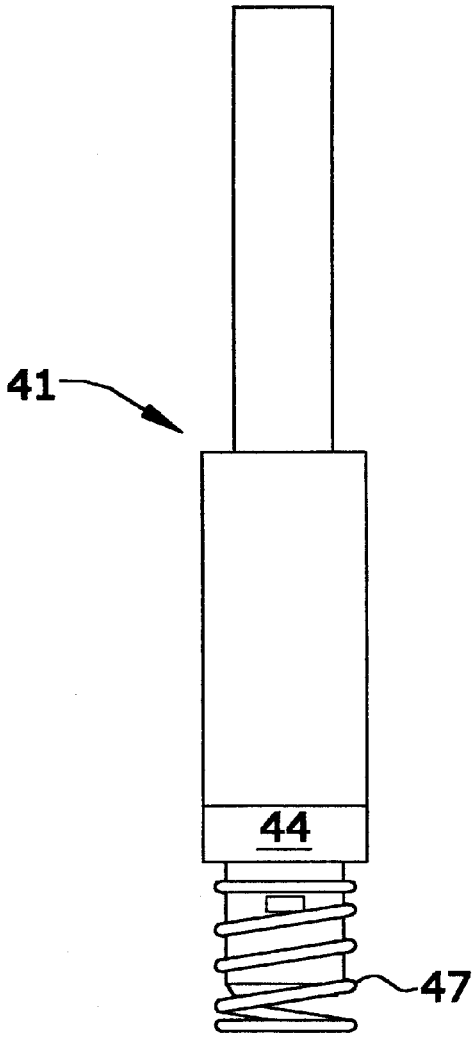
FIG. 5 is a top view of the cam and link lifter shown in FIG. 4.
Figure 6:
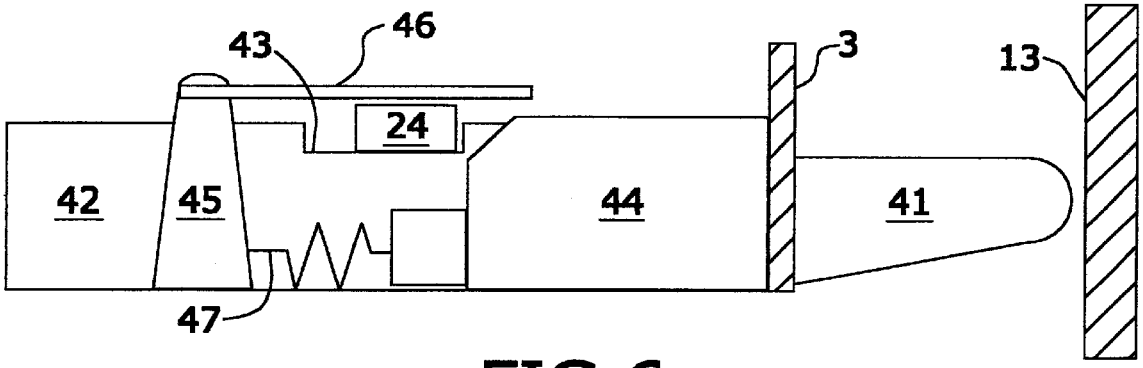
FIG. 6 is a schematic side view of the latching system of the invention as it appears when the door is open.
Figure 7:
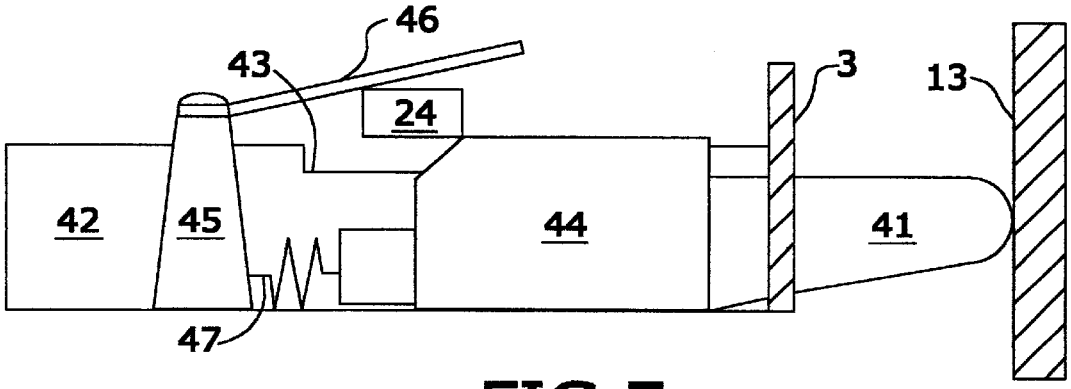
FIG. 7 is a schematic side view of the system of FIG. 6 as it appears when the door is almost all the way closed, with the link lifted almost completely out of the latch.
Figure 8:
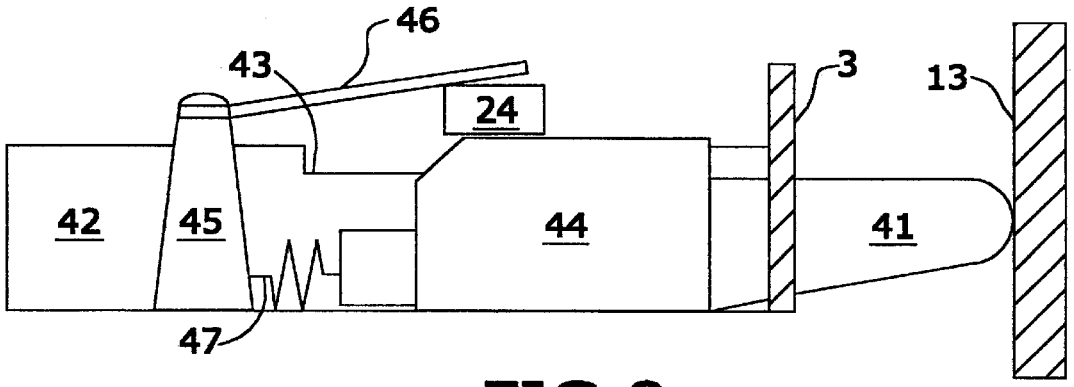
FIG. 8 is a schematic side view of the system of FIGS. 6 and 7 as it appears when the door is closed after the latch has been removed from the latch and moved toward the door jamb.
Figure 9:
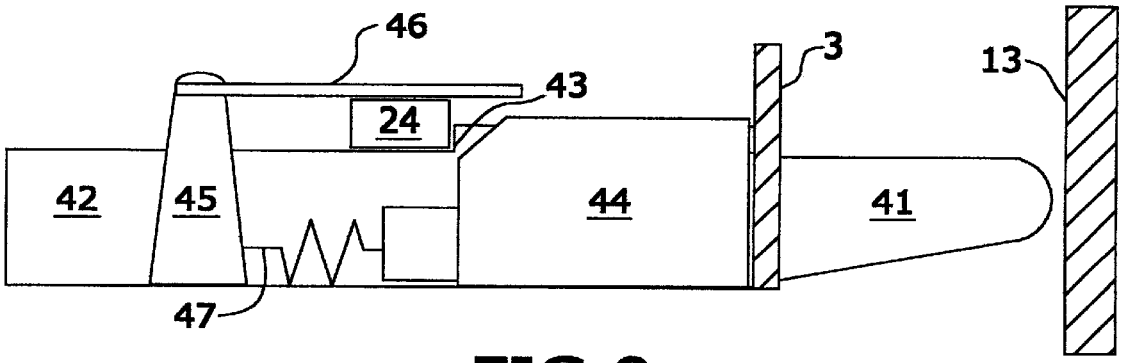
FIG. 9 is a schematic side view of an alternative embodiment of the invention as it appears when the door is open.
Figure 10:
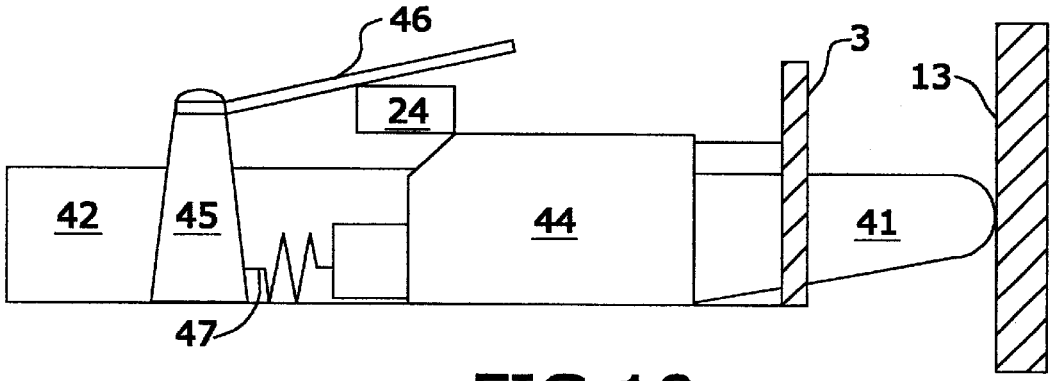
FIG. 10 is a schematic side view of the alternative embodiment of the invention shown in FIG. 9 as it appears when the door is almost completely closed, with the link lifted almost completely out of engagement with the latch.
Figure 11:
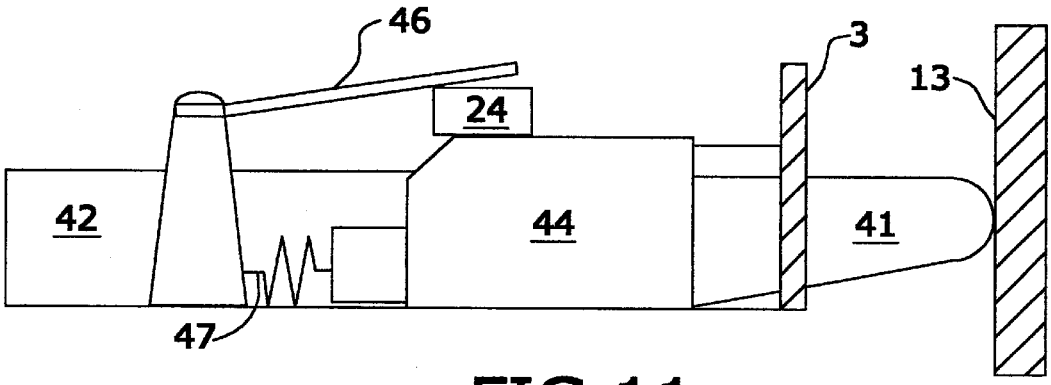
FIG. 11 is a schematic side view of the system of FIGS. 9 and 10 as it appears when the door is closed after the latch has been removed from the latch and moved toward the door jamb.

Our invention can be used in any door, gate, or related body, but is preferably used in the doors of insulated steel shell safes. Such a safe door 1 is shown in the Figures and comprises a front door plate 2 attached to a door jamb 3 with insulation 4 of some sort filling the space between the plate 2 and the door jamb 3. The door jamb 3 is a part on the door 1 and the body jamb 13 of the door is a part mounted on a frame for the door or in the body of a safe or other structure. A combination lock knob 5 and a handle 6 are mounted on the exterior of the front plate 2 for operating a combination lock 10 and a live bolt system 20, respectively. The knob 5 and the handle 6 are attached to spindles 7 running through the insulation 4 to components mounted on the back of the door jamb 3. The spindles 7 pass through bushings 8 that extend from the back of the front door plate 2 to the door jamb 3. The bushings 8 also have stubs 9 projecting rearwardly of the door jamb 3 on which components of the combination lock 10 and the live bolt system 20 are mounted. The stub 9 of the combination lock bushing 8 carries the driver 11 and tumblers 12 of the combination lock 10. The stub 9 of the handle bushing 8 carries the driver 21 and components for the live bolt system of the door.

The live bolt system driver 21 drives links 22–25 connected to live bolts 26 mounted near the sides of the door 1. When the handle 6 rotates, the handle spindle 7 transmits the rotation to the driver 21. The driver 21 is preferably a pinion comprising teeth 30 that engage the teeth of racks 31 on the links. The engagement of the racks 31 with the pinion teeth 30 causes substantially linear translation of the links 22–25 in response to rotation of the handle 6. Linear motion of the links 22–25 then causes linear motion of the live bolts 26 into and out of the body of the safe or body jamb 13 of the door 1 in accordance with operation of the handle 6.

Figure 12:
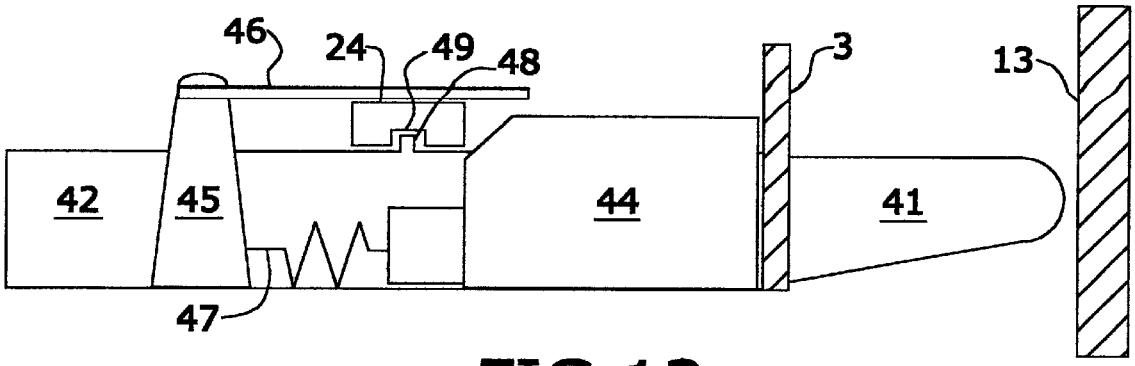
FIG. 12 is a schematic side view of another embodiment of the invention as it appears when the door is open.
Figure 13:
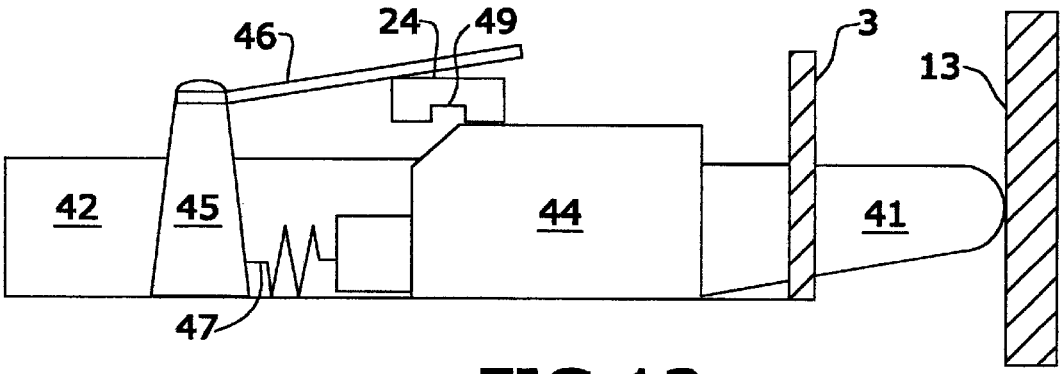
FIG. 13 is a schematic side view of the alternative embodiment of the invention shown in FIG. 12 as it appears when the door is almost completely closed, with the link lifted almost completely out of engagement with the latch.
Figure 14:
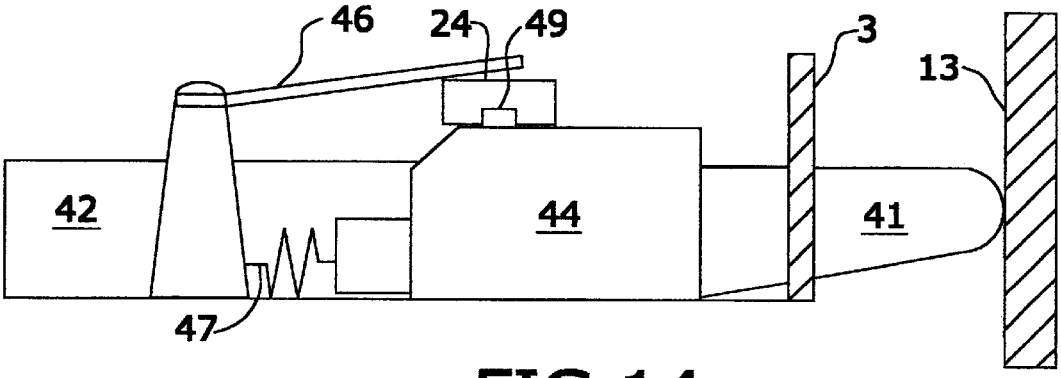
FIG. 14 is a schematic side view of the system of FIGS. 12 and 13 as it appears when the door is closed after the latch has been removed from the latch and moved toward the door jamb.

According to the preferred embodiment of our invention as shown schematically in FIGS. 6–11, the link 24 nearest the hinge side 50 of the door is acted upon by the latching system 40 we have invented. The link 24 passes over an actuator 41, preferably a cam, mounted between a set of guide walls 42 attached to the back of the door jamb 3. Each guide wall 42 has a step or recess 43 formed in it, the steps or recesses 43 being aligned with the link 24 such that they act as latches for the link 24. While the preferred embodiment uses a step or recess 43 in each guide wall 42 to retain the link 24, an alternative embodiment can use a projection 48 on the guide wall 42 that engages a step or recess 49 in the link 24 to retain the link 24 in a latched position as shown schematically in FIGS. 12–14.

The cam 41 is biased toward the hinge side 50 of the door 1 by a spring 47. The link 24 is preferably biased into the latch 43 by a force that can be provided by gravity or a resilient body, such as a spring or a resilient link 24. A hold-down spring 46, preferably a leaf spring mounted on a post 45 on the side of the link 24 opposite the door hinge 51, biases the link 24 into the latches 43. The latches 43 in the guide walls 42 prevent motion of the link 24 toward the hinge 51, thus preventing travel of the live bolts 26 carried by the link 24 into the body of the safe or the body jamb 13 of the door 1. Because of the rack and pinion arrangement of the live bolt system, when this link 24 is held in place, all links 22–25 are held in place, and none of the live bolts 26 can enter the body of the safe or the body jamb 13 of the door 1.

The cam 41 protrudes from the side of the door 50 such that it engages the body of the safe as the door 1 is closing. As the door 1 continues to close, the cam 41 travels toward the link 24 between the guide walls 42. A link lifter 44, preferably formed as part of the cam 41, lifts the link 24 out of the latches 43 against the bias of the hold-down spring 46 as the cam 41 moves toward the link 24. The link lifter 44 can be an inclined surface of the cam 41 leading from a thinner or recessed section of the cam 41 to a thicker section of the cam 41. Thus, as the cam 41 travels toward the link 24, the effective thickness of the cam 41 at the point of contact with the link 24 increases.

When the door 1 is fully closed, travel of the cam 41 causes the link 24 to move out of the latch. In the preferred embodiment, at least a small clearance is provided such that the link 24 clears the lip of the recesses 43. Springs 27 attached to the door jamb 3 and to the links 22–25 bias the links 22–25 toward the body of the safe or body jamb 13 of the door 1, forcing the live bolts 26 into the body of the safe or the body jamb 13 of the door 1. Thus, the links 22–25 and live bolts 26 are locked in an open position until the door 1 is substantially fully closed, at which point the live bolts 26 are automatically inserted into the body of the safe or the body jamb 13 of the door 1. Because the live bolts 26 are latched in place until the door 1 is closed, and because the latching occurs automatically when the door 1 is opened, damage due to attempted closures of the door 1 with the live bolts 26 extended is prevented. Further, because the latching system 40 and cam 41 are disposed on the hinge side 50 of the door, the risk of accidental release of the latching system 40 by bumping the cam 41 is minimized.

All parts of the live bolt and latching systems 20, 40 are preferably made from resinous material except for the links 22–25, the live bolts 26, and the springs 27, 46, 47. The links 22–25 and the live bolts 26 are preferably made of die cast metal. The springs 27, 46, 47 are preferably formed of spring steel. The hold-down spring 46 can be of any suitable type, but is preferably a leaf spring. The springs 27 biasing the links 22–25 toward the sides of the door 1 and the spring 47 biasing the cam 41 are preferably coil springs.

PARTS LIST

1 Door
2 Front door plate
3 Door jamb
4 Insulation
5 Combination lock knob/dial
6 Handle
7 Spindles
8 Bushings
9 Stubs of bushings
10 Combination lock
11 Combination lock driver
12 Tumbler discs
13 Body jamb of the door
20 Live bolt system
21 Live bolt driver
22–25 Live bolt links
26 Live bolts
27 Link biasing spring
30 Pinion teeth on live bolt driver
31 Rack teeth on link
40 Latching system
41 Cam/Actuator
42 Guide wall
43 Recess/latch
44 Link lifter
45 Post
46 Link biasing spring
47 Cam biasing spring
48 Projection on guide wall
49 Step or recess in link
50 Hinge side of door
51 Hinge

We claim:

1. In a door mounted in a jamb, a live bolt latching system comprising:

a. a latch substantially fixed relative to a rear surface of the door, b. a live bolt link selectively engaged and retained by the latch, the live bolt link being drivingly connected to a door handle, the latch preventing insertion of a live bolt operatively connected to the live bolt link from being inserted into the jamb when the link is retained thereby;

c. a hold-down spring biasing the link into the latch;

d. a cam that engages the jamb and slides into the door when the door is closed; and e. a link lifter that engages and forces the link out of the latch when the cam travels a predetermined distance toward the link.

2. The latching system of claim 1 wherein the link lifter is integral and one piece with the cam.

3. latching system of claim 2 wherein the link lifter is an inclined surface of the cam.

4. The latching system of claim 1 wherein the link carries a live bolt and a resilient body biases the link toward the jamb for automatic insertion of the live bolt into the jamb when the link is forced out of the latch.

5. The latching system of claim 1 wherein a resilient body biases the cam toward the jamb.

6. The latching system of claim 1 wherein the latch is a step in a guide wall on the back of the door.

7. The latching system of claim 1 wherein the latch is a recess in a guide wall on the back of the door.

8. The latching system of claim 1 wherein the latch is a projection on the guide wall engaging a step of the link.

9. The latching system of claim 1 wherein the latch is a projection on the guide wall engaging a recess of the link.

10. The latching system of claim 1 wherein the door includes a hinge and the cam is mounted adjacent a side of the door on which the hinge is mounted.

11. In a door swingablly mounted in a jamb, a live bolt latching system comprising:

a. an actuator mounted on the door and responsive to motion of the door by virtue of a portion of the actuator that engages the jamb when the door is closed;

b. a latch mounted on the door and substantially fixed relative to a rear surface of the door;

c. a spring biasing a live bolt link into the latch when the link overlies the latch such that the latch prevents the link from forcing a live bolt into the jamb in response to a bias imposed by another spring biasing the link toward the jamb; and d. a link lifter responsive to operation of the actuator to overcome the bias of the spring and disengage the live bolt link from the latch when the door is closed.

12. The latching system of claim 11 wherein the actuator is a cam mounted on the door such that it engages the jamb when the door is closing.

13. The latching system of claim 12 wherein the link lifter is an inclined surface of the cam.

14. The latching system of claim 12 wherein a resilient body biases the cam toward engagement with the jamb.

15. The latching system of claim 11 wherein the link lifter is part of the actuator.

16. The latching system of claim 11 further including a guide wall mounted on the door, the latch being a step formed in the guide wall and adapted to receive the link.

17. The latching system of claim 11 further including a guide wall mounted on the door, the latch being a recess formed in the guide wall and adapted to receive the link.

18. The latching system of claim 11 further including a guide wall mounted on the door, the latch being a projection formed on the guide wall and adapted to engage a step on the link.

19. The latching system of claim 11 further including a guide wall mounted on the door, the latch being a projection formed on the guide wall and adapted to engage a recess in the link.

20. The latching system of claim 11 wherein the door includes a hinge and the actuator is mounted adjacent a side of the door on which the hinge is mounted.

21. The latching system mounted to a swinging in a door comprising:

a. a latch receiving a link in response to actuation of a handle, the latch being substantially fixed relative to a rear surface of the door and retaining the link via a force imposed by a resilient body biasing the link into the latch;

b. an actuator that engages a iamb of the door when the door is closed and, by virtue of its engagement with the jamb, overcomes the force and releases the link from the latch when the door is fully closed; and c. a live bolt on the link that is automatically inserted into a jamb when the door is closed and the link is released from the latch.

22. The latching system of claim 21 wherein the latch is a step in a guide wall adapted to guide the actuator along an actuation path.

23. The latching system of claim 21 wherein the latch is a recess in a guide wall adapted to guide the actuator along an actuation path.

24. The latching system of claim 21 wherein the latch is a projection formed on a guide wall adapted to guide the actuator along an actuation path, the projection engaging a step on the link.

25. The latching system of claim 21 wherein the latch is a projection formed on a guide wall adapted to guide the actuator along an actuation path, the projection engaging a recess in the link.

26. The latching system of claim 21 wherein the resilient body is a spring.

27. The latching system of claim 21 wherein the actuator includes a link lifter that removes the link from the latch.

28. The latching system of claim 21 wherein a spring biases the link toward automatic insertion of the live bolt into the jamb.

29. The latching system of claim 21 wherein a spring biases the actuator toward engagement with the jamb.

30. The latching system of claim 21 wherein the actuator includes a link lifter comprising an inclined surface of the actuator that acts on the link as the door closes and that overcomes the force biasing the link into the latch when the door is substantially fully closed.

31. The latching system of claim 21 in which the door includes a hinge and the actuator is mounted adjacent a side of the door on which the hinge is mounted.

* * * * *